United States Patent [19]

Wilson

[11] Patent Number: 4,930,165

[45] Date of Patent: Jun. 5, 1990

[54] FOLDING COMMODE SEAT

[76] Inventor: Arlon R. Wilson, 1216 Norris Dr., Bossier City, La. 71111

[21] Appl. No.: 263,237

[22] Filed: Oct. 27, 1988

[51] Int. Cl.[5] ..... A47K 13/02

[52] U.S. Cl. ..... 4/235; 4/239; 4/242; 5/437; 5/465; 16/225

[58] Field of Search ..... 4/234, 235, 237, 239, 4/242, 243, DIG. 8; 297/219; 5/90, 437, 465; 16/225, DIG. 13

[56] References Cited

U.S. PATENT DOCUMENTS

| | | | |
|---|---|---|---|
| 682,871 | 9/1901 | Hogan et al. | 4/242 |
| 1,068,109 | 7/1913 | Comins | 4/243 |
| 1,575,640 | 3/1926 | Ragland | 4/242 |
| 1,592,597 | 7/1926 | Becker | 4/243 |
| 1,927,109 | 9/1933 | Abarms | 5/465 |
| 2,241,101 | 5/1941 | Teeter | 16/225 X |
| 2,481,427 | 9/1949 | Hunter | 4/242 |
| 2,537,906 | 11/1951 | Over | 5/90 X |
| 2,607,411 | 8/1952 | Van Vliet | 16/225 X |
| 2,706,767 | 4/1955 | Packchanian | 4/242 |
| 2,978,020 | 4/1961 | Paulsrude | 16/225 X |
| 3,535,718 | 10/1970 | Murcott | 128/878 |
| 3,640,273 | 2/1972 | Ray | 128/87 |
| 4,525,880 | 7/1985 | Bass | 4/244 |

FOREIGN PATENT DOCUMENTS

| | | | |
|---|---|---|---|
| 817643 | 7/1949 | Fed. Rep. of Germany | 4/242 |
| 3328306 | 2/1985 | Fed. Rep. of Germany | 4/234 |
| 946152 | 1/1964 | United Kingdom | 4/237 |
| 1180551 | 2/1970 | United Kingdom | 4/242 |

*Primary Examiner*—Henry J. Recla
*Assistant Examiner*—R. M. Fetsuga
*Attorney, Agent, or Firm*—John M. Harrison

[57] ABSTRACT

A folding commode seat for use primarily by wheelchair bound persons, which seat includes a generally C-shaped panel constructed of a vinyl-dipped foam material and having a flexible hinge therein at a base end thereof, with spaced panel segments extending forwardly from the flexible hinge and terminating in spaced relationship at the opposite ends. A pair of short web straps are secured in spaced relationship to the inside margins of each of the folding panel segments and a pair of longer Velcro straps are attached in spaced relationship to the outside of the folding panel segments opposite the web straps, respectively. A strap loop is attached to the extending ends of each of the web straps and the folding commode seat is attached to a conventional commode seat on a commode bowl by extending the Velcro straps beneath the conventional commode seat and through the respective strap loops, and subsequently folding the Velcro straps to engage the respective loop and pile fasteners attached to the Velcro straps, for securing the respective panel segments of the folding commode seat on top of the existing commode seat. Alternatively, the respective web straps and Velcro straps can each be shaped from a single strap and laminated to the the bottom of the vinyl-dipped foam panel segments, as desired.

2 Claims, 1 Drawing Sheet

FOLDING COMMODE SEAT

BACKGROUND OF THE INVENTION

1. Field of the Invention

This invention relates to commode seats for wheelchair bound persons and more particularly, to a folding commode seat which is characterized by a generally C-shaped, resilient panel foldable at the base end by a flexible hinge to define a pair of symmetrical panel segments which are provided with four sets of web straps and Velcro straps of dissimilar length, for securing the folding commode seat on an existing commode seat. In a preferred embodiment of the invention, the folding commode seat may be folded on the flexible hinge to align the panel segments and inserted in a carrying bag for convenience in transportation. In another preferred embodiment of the invention, the folding commode seat is constructed of a vinyl-dipped foam material which is soft and contoured to fit on conventional commode seats.

2. Description of the Prior Art

Various types of commode and toilet seats are known in the art. U.S. Pat. No. 1,720,129, dated July 9, 1929, to R. M. Kinnard, details a "Toilet Seat" having a size-adjusting mechanism attached thereto. U.S. Pat. No. 2,584,141, dated Feb. 5, 1952, to R. Liebling, details a "Toilet Seat" which further includes a size-adjusting mechanism to accommodate children. A Sept. 12, 1967, to A. H. Moore, et al. The toilet seat includes a seat portion of suitable size to accommodate a child, which seat portion may be hingedly located on the existing toilet seat, as desired. U.S. Pat. No. 3,364,505, dated Jan. 23, 1968, to R. E. Palmier, details a "Toilet Seat Elevator". The device includes a removable, elevated seat portion which is provided with bottom clips for clipping to the rim of a commode bowl. An "Auxiliary Toilet Seat" is detailed in U.S. Pat. No. 3,392,411, dated July 16, 1968, to D. W. Hansen. The auxiliary toilet seat includes a removable seat portion which has a pair of upward-standing support arms and a back support for removably mounting on the rim of a toilet bowl. U.S. Pat. No. 3,490,082, dated Jan. 20, 1970, to C. E. Murcott, details a "Height Adjustable Auxiliary Toilet Seat". The toilet seat of this invention includes a seat portion provided with spaced legs which receive clamps for clamping the seat portion in elevated fashion to the rim of a commode bowl. An "Invalid or Geriatric Toilet Seat" is detailed in U.S. Pat. No. 3,671,981, dated June 27, 1972, to Sarah E. Smith. The seat includes a core having a rigid upper portion and a resilient lower section, which core is coated with a material having a smooth finish and at least the lower portion of the coating is flexible to allow the lower surface of the seat to conform to the shape of the surface upon which it is placed or to stabilize the seat in position on the conventional toilet seat. U.S. Pat. No. 4,462,122, dated July 31, 1984, to John Broeils, details a "Raised Superimposed Toilet Seat and Securing Clamp". The raised toilet seat is superimposed upon the bowl of the conventional toilet and includes a clamp for removably attaching the raised toilet seat to the toilet bowl. U.S. Pat. No. 4,477,932, dated Oct. 23, 1984, to Theodore Lenosky, details a similar "Raised Superimposed Toilet Seat and Securing Clamp". As in the case of the Broeils patent, the Lenosky toilet seat is superimposed upon the bowl of the conventional toilet and includes a clamp for securing the raised toilet seat to the commode bowl.

It is an object of this invention to provide a portable folding commode seat which is comfortable, easily folded, stored and carried and may be quickly and easily unfolded and deployed on an existing commode or toilet seat.

Another object of the invention is to provide a folding commode or toilet seat which is characterized by a generally C-shaped, resilient panel having a hinge to facilitate folding the panel into a pair of aligned panel segments, thus allowing convenient transportation and easy deployment on a conventional toilet or commode seat.

Still another object of the invention is to provide a new and improved, portable commode seat of selected size and thickness which is characterized by a pair of curved, vinyl-dipped foam panel segments joined at one end by a flexible hinge and provided with a system of spaced straps for removably attaching the commode seat to the seat of a conventional toilet or commode.

Yet another object of the invention is to provide a new and improved, portable, hinged commode seat constructed of vinyl-dipped foam material and provided with spaced belts or straps, each having a strap loop element and a companion loop and pile Velcro attachment element for deploying and securing the commode seat on the conventional seat of a toilet or commode and subsequently folding the commode seat on the hinge for storage in a carrying bag.

Another object of this invention is to provide a new and improved folding, resilient commode seat for use by wheelchair-bound persons, which commode seat is characterized by a generally C-shaped panel constructed of vinyl-dipped foam material, such as foam rubber, and provided with a flexible hinge near the center thereof, to define a pair of substantially symmetrical panel segments which align when the panel is folded. The panel is provided with spaced sets of belts or straps, one end of which straps in each set is fitted with a strap loop and the other end containing loop and pile Velcro connecting elements, such that the folding commode seat may be deployed on a conventional commode seat and the straps used to removably secure the folding commode seat thereon.

SUMMARY OF THE INVENTION

These and other objects of the invention are provided in a new and improved, flexible folding commode seat which is constructed of vinyl-dipped foam material and is characterized by a panel shaped to fit on a conventional commode seat and having a flexible hinge in the center thereof. The panel is provided with four sets of spaced straps, one of which straps in each set having a strap loop at one end for receiving the opposite strap end, which is fitted with loop and pile elements, for removably securing the commode seat on the conventional seat of a commode or toilet and subsequently folding the commode seat at the flexible hinge to align the symmetrical panel segments and inserting the folded commode seat in a carrying bag for easy transportation and storage.

BRIEF DESCRIPTION OF THE DRAWING

The invention will be better understood by reference to the accompanying drawing, wherein.

DESCRIPTION OF THE PREFERRED EMBODIMENTS

Figure 1:
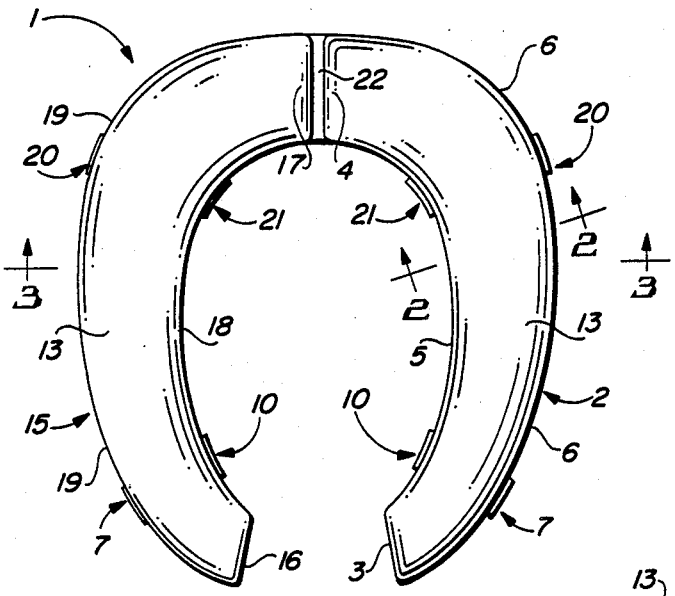
FIG. 1 is a top view of a preferred embodiment of the folding commode seat of this invention.

Referring initially to FIG. 1 of the drawing, the folding commode seat of this invention is generally illustrated by reference numeral 1 and is characterized by a generally C-shaped panel defined by a curved right-hand panel segment 2 and a corresponding, symmetrical left-hand panel segment 15. The right-hand base end 4 of the right-hand panel segment 2 is connected to the left-hand base end 17 of the left-hand panel segment 15 by means of a panel hinge 23 and a reduced thickness of material at the folding space 22. In a most preferred embodiment of the invention the panel hinge 23 is characterized by a flexible material such as nylon webbing or a polyethylene, polypropylene or other "plastic" sheet material of suitable thickness which is able to withstand multiple flextures and folding without failure. However, it will be appreciated by those skilled in the art that other materials, including webbing or belting of various composition, in non-exclusive particular, may be utilized as a panel hinge 23, according to the knowledge of those skilled in the art. The right-hand panel segment 2 terminates at the right-hand extending end 3 opposite the right-hand base end 4, and the left-hand panel segment 15 terminates at the left-hand extending end 16, opposite the left-hand base end 17. In a preferred embodiment of the invention the right-hand extending end 3 of the right-hand panel segment 2 is spaced from the left-hand extending end 16 of the left-hand panel segment 15, as illustrated, and the panel hinge 23 is located in the center of the panel defining the folding commode seat 1.

Figure 3:
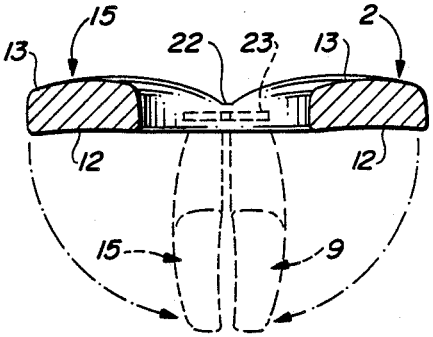
FIG. 3 is a sectional view taken along line 3—3 of the folding commode seat illustrated in FIG. 1, with the folding characteristic of the folding commode seat illustrated in phantom.
Figure 6:
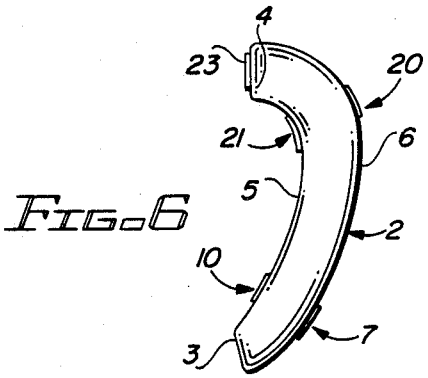
FIG. 6 is a top view of the folding commode seat illustrated in FIG. 1 in folded configuration.

Referring now to FIGS. 1, 3 and 6 of the drawing, in a preferred embodiment of the invention the panel hinge 23 is embedded in the right-hand base end 4 of the right-hand panel segment 2 and the left-hand base end 17 of the left-hand panel segment 15 and a folding space 22 is maintained between the right-hand base end 4 and the left-hand base end 17. This configuration of the panel hinge 23 facilitates folding of the right-hand panel segment 2 and the left-hand panel segment 15 downwardly at the panel hinge 23 in the direction of the arrows, as illustrated in phantom in FIG. 3, to the configuration illustrated in FIG. 6. In a most preferred embodiment of the invention, the right-hand panel segment 2 and the left-hand panel segment 15 of the folding commode seat 1 are constructed of a vinyl-dipped foam material and the panel hinge 23 is characterized by a nylon webbing material embedded in the right-hand base end 4 and the left-hand base end 17, according to techniques which are well known to those skilled in the art. Alternatively, the panel hinge 23 can be laminated to the bottom margins 12 of the right-hand panel segment 2 and the left-hand panel segment 15, further according to the knowledge of those skilled in the art. Furthermore, the top margin 13 of both the right-hand panel segment 2 and the left-hand panel segment 15 is convex in order to facilitate a more comfortable seating configuration, while the bottom margin 12 of the right-hand panel segment 2 and the left-hand panel segment 15 is slightly concave, in order to rest securely on the normally curved top surface of a conventional commode seat.

Figure 2:
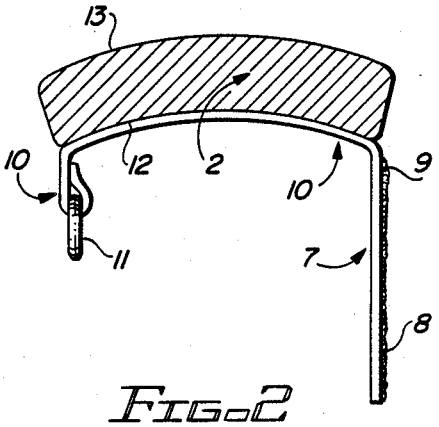
FIG. 2 is a sectional view taken along line 2—2 of the right-hand panel segment of the folding commode seat illustrated in FIG. 1.
Figure 4:
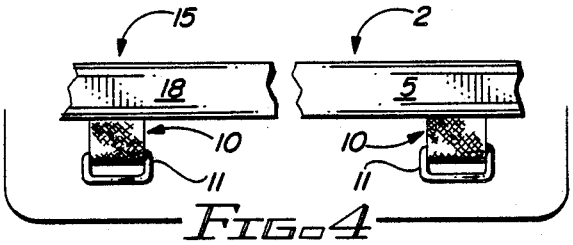
FIG. 4 is a side view, partially in section, of a portion of the inside margins of the folding commode seat illustrated in FIG. 1, more particularly illustrating a preferred web strap and strap loop feature.
Figure 5:
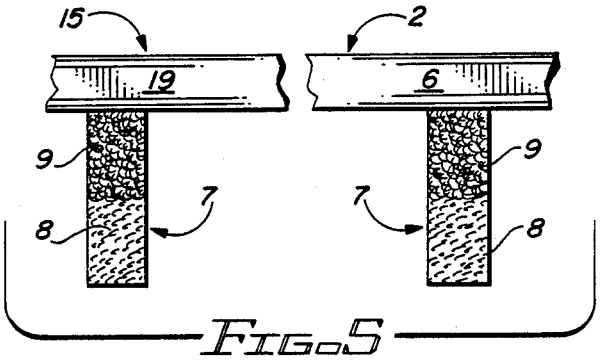
FIG. 5 is a side view, partially in section, of a portion of the outside margins of the folding commode seat illustrated in FIG. 1, more particularly illustrating a pair of loop and pile-equipped straps.

Referring now to FIGS. 1, 2, 4 and 5 of the drawings, in a most preferred embodiment of the invention one end of a pair of forward Velcro straps 7 are attached to the forward end portions of the right-hand outside margin 6 of the right-hand panel segment 2 and the left-hand outside margin 19 of the left-hand panel segment 15, respectively, as illustrated in FIGS. 1 and 5. Furthermore, one end of a shorter pair of shorter forward web straps 10 are secured to the forward portion of the right-hand inside margin 5 of the right-hand panel segment 2 and the left-hand inside margin 18 of the left-hand panel segment 15, respectively, opposite the forward Velcro straps 7, respectively, as further illustrated in FIGS. 2 and 4. A strap loop 11 is fitted to the extending ends of each of the forward web straps 10, as illustrated in FIGS. 2 and 4, in order to receive the respective extending ends of the companion longer forward Velcro straps 7, respectively, and secure the folding commode seat 1 on a conventional commode seat, as hereinafter further described.

Figure 8:
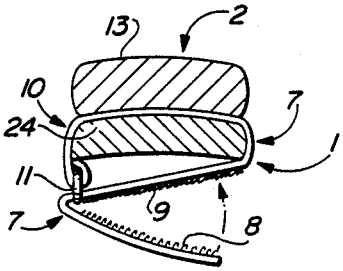
FIG. 8 is a sectional view of one of the panel segments of the folding commode seat mounted on a conventional commode seat.

Referring to FIGS. 2, 4, 5 and 8, each of the forward Velcro straps 7 is further provided with a segment of loop fasteners 8 and pile fasteners 9 on the outside surface thereof, as illustrated in FIGS. 2 and 5, in order to facilitate extending the respective ends of the forward Velcro straps 7 through the opposite strap loops 11 and subsequently folding the loop fastener 8 on the pile fasteners 9 of the forward Velcro straps 7, to secure the folding commode seat 1 in position on a conventional commode seat 24, as illustrated in FIG. 8. As further illustrated in FIGS. 1, 2, 4, 5 and 8, a second set of rear web straps 21 are attached to the right-hand inside margin 5 of the right-hand panel segment 2 near the right-hand base end 4 and to the left-hand inside margin 18 of the left-hand panel segment 15 near the left-hand base 17, respectively. Furthermore, a pair of rear Velcro straps 20 are secured to the right-hand outside margin 6 of the right-hand panel segment 2, opposite the companion rear web strap 21 and to the left-hand outside margin 19 of the left-hand panel segment 15 opposite the second companion rear web strap 21, as illustrated. Each of the shorter rear web straps 21 is further provided with a strap loop 11, for receiving the opposite companion rear Velcro strap 20 and further facilitating attachment of the folding commode seat 1 to the conventional commode seat 24, as illustrated in FIG. 8.

Referring again to FIGS. 2 and 8 of the drawing, while the respective forward velcro straps 7 and forward web straps 10 and the rear Velcro straps 20 and rear web straps 21 may be characterized by separate straps embedded in the respective right-hand panel segment 2 and left-hand panel segment 15, in a most preferred embodiment of the invention, each forward Velcro strap 7-forward web strap 10 and rear Velcro strap 20-rear web strap 21 combination is a single strap laminated to the bottom margin 12 of the right-hand panel segment 2 and the left-hand panel segment 15, respectively. This lamination may be easily effected in the vinyl-coated foam material according to techniques which are well known to those skilled in the art. Moreover, the strap material used may be characterized by nylon or fabric webbing or belting of suitable strength, further according to the knowledge of those skilled in the art.

Figure 7:
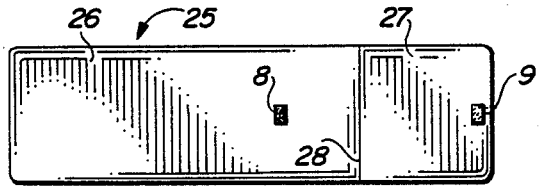
FIG. 7 is a top view of a preferred bag or container for receiving and storing the folding commode seat in folded configuration.

Referring now to FIG. 7 of the drawing, in another preferred embodiment of the invention, a bag 25 is designed to contain the folding commode seat 1 and includes a bag pouch 26, for receiving the right-hand panel segment 2 and left-hand panel segment 15, when folded as illustrated in FIG. 6. A closure flap 27 is also provided in the bag 25 for closing the folding commode seat 1 inside the bag pouch 26. Accordingly, when the right-hand panel segment 2 and left-hand panel segment 15 of the folding commode seat 1 are folded against each other by operation of the panel hinge 23, as illustrated in phantom in FIG. 3 and the closure flap 27 is closed over the pouch margin 28, the pile fasteners 9, located on the closure flap 27, are closed on the loop fasteners 8 provided on the bag pouch 26 and the folding commode seat 1 is securely located inside the bag 25 for storage or transportation purposes.

It will be appreciated by those skilled in the art that the folding commode seat 1 of this invention is particularly well suited for wheelchair-bound persons of all ages, size and weight, since the right-hand panel segment 2 and the left-hand panel segment 15 can be constructed of suitable size and thickness to accommodate a person of any size and weight. The folding commode seat 1 is easily retrieved from the carrying bag 25, unfolded, and strapped to an existing conventional commode seat 24, as heretofore described with regard to FIGS. 3 and 8 of the drawing. Furthermore, the folding commode seat 1 can be constructed of substantially any desired material, but as heretofore previously described, is most preferably constructed of vinyl-dipped foam materials, such as foam rubber compositions which are commonly used to protect football players, which material is light in weight and easily shaped and used for the purpose described herein.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A folding commode seat for removably mounting on a conventional commode seat, comprising a pair of substantially symmetrical panel segments foldable against each other and shaped to fit on the conventional commode seat, said panel segments being vinyl coated foam material a bendable plastic hinge embedded in said foam material of said panel segments for selectively folding said panel segments and unfolding said panels segments for deployment on the conventional commode seat and at least one panel strap carried by said panel segments for securing said panel segments to the conventional commode seat, said panel strap further comprising a strap loop attached to one end of said panel strap and a plurality of loop and pile fasteners provided on the opposite end of said panel strap, whereby said opposite end of said panel strap is looped beneath the conventional commode seat and extended through said strap loop and said loop and pile fasteners are then engaged, to secure said folding commode seat on the conventional commode seat.

2. The folding commode seat of claim 1 wherein said at least one panel strap further comprises four panel straps laminated to the bottom of said panel segments in spaced relationship.

* * * * *